US006192543B1

(12) United States Patent
Lee

(10) Patent No.: US 6,192,543 B1
(45) Date of Patent: Feb. 27, 2001

(54) CLEANING MITT APPARATUS

(76) Inventor: Timothy R. Lee, P.O. Box J, Glendale, OR (US) 97442

( * ) Notice: Subject to any disclaimer, the term of this patent is extended or adjusted under 35 U.S.C. 154(b) by 0 days.

(21) Appl. No.: 09/344,166

(22) Filed: Jun. 24, 1999

Related U.S. Application Data

(60) Provisional application No. 60/121,558, filed on Feb. 25, 1999.

(51) Int. Cl.[7] ..... A47L 13/12; A47L 13/18

(52) U.S. Cl. ..... 15/118; 15/227; 2/158; 2/161.8; 451/523; 451/461

(58) Field of Search ..... 15/104.94, 118, 15/227; 2/158, 161.8; 401/7; 451/523, 526, 539, 461

(56) References Cited

U.S. PATENT DOCUMENTS

| | | | | |
|---|---|---|---|---|
| 1,782,502 | * | 11/1930 | Crane | 15/227 |
| 2,227,707 | * | 1/1941 | Cooper | 15/227 |
| 2,374,068 | * | 4/1945 | Baldeschwieler | 15/227 |
| 2,875,461 | * | 3/1959 | Anderson | 15/118 |
| 3,151,333 | | 10/1964 | Scholz | 2/161.8 |
| 3,169,264 | * | 2/1965 | Walker | 15/118 |
| 3,589,819 | | 6/1971 | Bryant | 401/7 |
| 3,748,792 | | 7/1973 | Lamb | 451/523 |
| 3,789,555 | | 2/1974 | Means | 451/523 |
| 3,885,249 | | 5/1975 | De Brabander | 15/227 |
| 4,038,787 | | 8/1977 | Bianchi | 451/523 |
| 4,107,840 | | 8/1978 | Kupperman et al. | 30/172 |
| 4,670,930 | * | 6/1987 | Lu | 2/158 X |
| 4,807,322 | * | 2/1989 | Littledeer | 15/118 X |
| 4,980,943 | * | 1/1991 | Barber | 15/227 |
| 5,134,809 | | 8/1992 | Morton et al. | 451/523 |
| 5,373,601 | * | 12/1994 | Miller | 15/118 |
| 5,815,876 | | 10/1998 | Overseth | 15/179 |
| 5,885,148 | | 3/1999 | Vargas et al. | 451/523 |

FOREIGN PATENT DOCUMENTS

| | | | | |
|---|---|---|---|---|
| 2333482 | * | 7/1977 | (FR) | 15/227 |
| 2530940 | * | 2/1984 | (FR) | 15/227 |

* cited by examiner

*Primary Examiner*—Mark Spisich
(74) *Attorney, Agent, or Firm*—Steven J. Adamson

(57) ABSTRACT

A cleaning mitt that provides a mild cleaning surface and a more abrasive cleaning surface. Water-absorbent material is preferably provided with these surfaces to hold water and cleanser during use. The mitt is particularly well suited for cleaning automobiles and the more abrasive cleaning surface is preferably designed to remove stubborn debris such as tar and dried bugs without damaging the finish of the automobile.

14 Claims, 1 Drawing Sheet

CLEANING MITT APPARATUS

CROSS REFERENCE TO RELATED APPLICATIONS

This application claims the benefit of U.S. Provisional Application No. 60/121,558, filed Feb. 25, 1999, and having the same title and inventor(s) as above.

FIELD OF THE INVENTION

The present invention relates to cleaning mitts for use in cleaning automobiles or other items.

BACKGROUND OF THE INVENTION

Cleaning mitts are known in the art. Typically they include a polyester or like batting configured to form a cavity having an open cuffed end.

While conventional cleaning mitts have been of assistance in automobile and other item cleaning, they also have disadvantageous aspects. One of these is that the mitts have a fluffy almost sponge-like outer surface that while being good at retaining fluid and cleaning solution is not sufficiently abrasive to remove bugs, tar, and dried on dirt, etc.

Another disadvantageous aspect of present cleaning mitts is that they permit water to pass through to a user's hand. In cold weather and/or when used with cold water, this results in the hand becoming undesirably cold.

SUMMARY OF THE INVENTION

Accordingly, it is an object of the present invention to provide a cleaning mitt that includes at least one surface that has enhanced tar and bug removing properties.

It is another object of the present invention to provide a cleaning mitt that has a dry liner to maintain the inside of the cleaning mitt substantially dry.

It is also an object of the present invention to provide various cleaning mitt arrangements that provide a supplemental abrasive cleaning surface.

These and related objects of the present invention are achieved by use of a cleaning mitt apparatus and method as described herein.

The attainment of the foregoing and related advantages and features of the invention should be more readily apparent to those skilled in the art, after review of the following more detailed description of the invention taken together with the drawings.

DETAILED DESCRIPTION

Figure 1A:
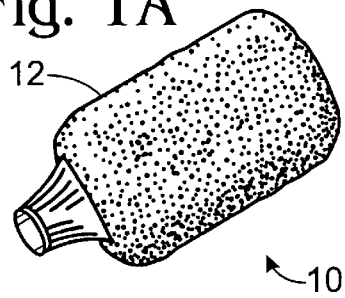
FIGS. 1A–1C are first and second side perspective views and an end view of a cleaning mitt in accordance with the present invention.
Figure 1B:
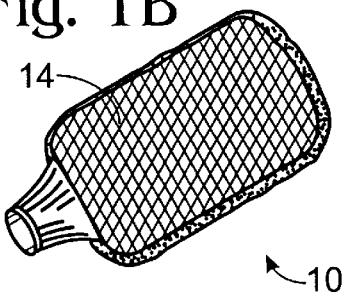
Figure 1C:
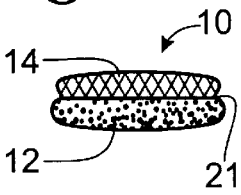

Referring to FIGS. 1A–1C, first and second side perspective views and an end view of a cleaning mitt 10 in accordance with the present invention are respectively shown. The general nature of cleaning mitt 10 is described first with reference to FIGS. 1A–1C. A description of how the mitt is made and various alternative embodiments follow.

FIG. 1A illustrates a side of mitt 10 that has a relatively mild cleaning surface (hereinafter termed "mild" surface 12). This surface is suitable for general car washing purposes, etc., and may be formed of conventional car mitt material.

FIG. 1B illustrates another side of mitt 10. This side contains a more abrasive cleaning surface (hereinafter termed "abrasive" surface 14).

FIG. 1C illustrates the non-cuffed end of mitt 10. This view shows the mild surface 12 on one side and the more abrasive surface 14 on the other side. A seam 21 is preferably formed between the two surfaces (though the actual seam may be internal to the mitt). Abrasive surface 14 is preferably formed as an abrasive mesh or other suitable material that is placed over the "fluffier" mild surface material and may compress the mild material to some extent. In this manner, the benefits of the abrasive material are available on an outer surface, while the mild surface material adjacent thereto acts to bias the abrasive surface outwardly and to hold water and cleaning solution.

By providing mild and abrasive surfaces in a single mitt, a user is able to simply rotate the mitt about their hand to achieve cleaning of both easily removable debris and stubborn debris.

A moisture barrier may also be provided within the mitt to keep the interior of the mitt dry. In this manner, a gloved hand could be used within the mitt in order to keep the hand warm. This feature is particularly advantageous for cooler climates. A description of the formation of an embodiment of mitt 10 is now provided.

Figure 2:
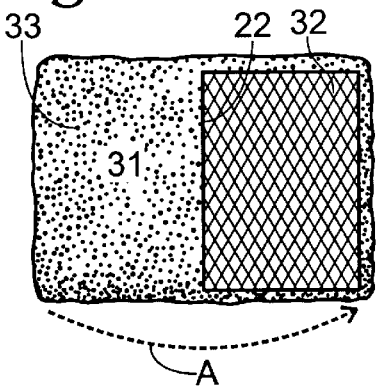
FIGS. 2–5 illustrate various stages in the formation of the mitt of FIGS. 1A–1C in accordance with the present invention.
Figure 3:
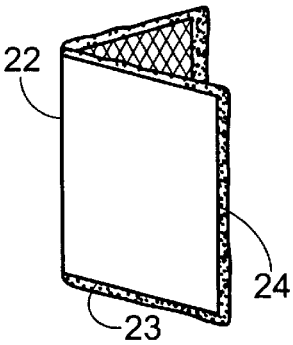

Referring to FIGS. 2–5, various stages in mitt 10 formation in accordance with the present invention are shown. In FIG. 2, a sheet 31 of mild surface material, with a sheet 32 of abrasive surface material laid over a portion thereof, is shown. The mild surface material 31 is preferably a polyester like material that has a substantially smooth surface (not shown) and a fluffy almost wool or sponge-like surface (shown). Such a material may be termed a polyester wool batting and is made by Cesyl Mills of Millbury, Mass. The material has a six denier face (fluffy side) and a 300 denier back (smooth side). In FIG. 2, the fluffy side is shown. A sheet of mesh 32 (i.e., the abrasive surface material) is preferably placed over approximately half of the face of the mild material on one side and a center seam 22 that joins one edge of the mesh to the mild surface material is stitched. The mesh material 32 is preferably a sufficiently non-abrasive material that will not damage the finish of an automobile, appliance, or other surface, while still being sufficiently abrasive to remove stubborn debris such as tar, and dried bugs and dirt, etc. A suitable material is a 100% polyester mesh model number 250 medium crisp from Jason Mills, Westwood, N.J. It should be recognized that while mesh 32 is preferably stitched on the non-abrasive material, the mesh or an equivalent may be woven or molded into the substrate material.

The remaining exposed face 33 of sheet 31 is then folded towards the abrasive sheet until the edges of the abrasive sheet 32 and the edge of the mild sheet line up (dashed arrow A). This folding over is shown partially in FIG. 3 and completely in FIG. 4. Seams 23 and 24 are then respectively sewn at the bottom and right side (from the perspective of FIG. 3). Seam 23 would be the same as seam 21 of FIG. 1C. The resultant product is the inside out mitt precursor shown in FIG. 4. The edge at seam 22 is smooth while the top, bottom and right sides have visible face material. Seams 23 and 24 seal the bottom and right side, respectively, and the top is open.

Figure 4:
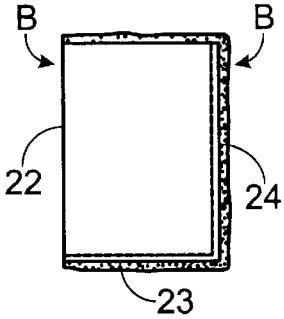
Figure 5:
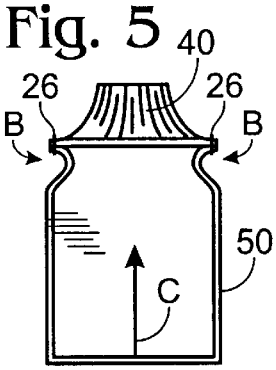

FIG. 5 illustrates the mounting of cuff 40. The inside out mitt precursor of FIG. 4 is pinched at arrows B to form a temporary vase like shape that terminates in a flange. Cuff material is aligned with the flange and securely stitched forming seam 26. A suitable cuff 40 is available commercially from Minnesota Knitting Mills of St. Paul, Minn. It is identified as a 100% polyester two-sided flared cuff (one piece of cuff material folded in half).

Suitable thread for the same described herein is Perma-Core Tex 40 made by American & Efird of Mount Holly, N.C.

FIG. 5 also illustrates the provision of a dry liner 50. A dry liner 50 may be provided over the inside out mitt precursor and stitched into place when the cuff is secured (seam 26). Alternatively, the dry liner could be inserted and secured once the mitt has been turned right side out. The dry liner 50 may be a 4 mil poly plastic bag. A suitable bag is made by Northeast Poly Bag Company of Sterling, Mass.

The sage of FIG. 5 is then turned right side out, by moving the bottom of the mitt up through the cuff opening in the direction of arrow C. The right side out mitt is shown in FIGS. 1A–1C. The smooth part is on the inside.

While a preferred embodiment has been described above, it should be recognized that other embodiments are contemplated and within the present invention. These include, but are not limited to, the following.

Figure 6:
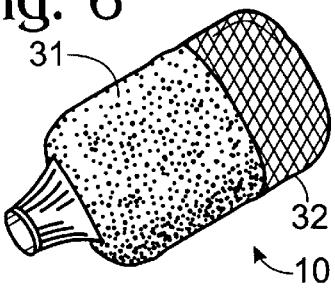
FIGS. 6–9 illustrative alternative embodiments of a cleaning mitt in accordance with the present invention.

Referring to FIG. 6, a mitt 10 is shown in which the abrasive mesh 32 is provided on one region of the mitt cleaning surface, for example, the fingertip region. The abrasive material may be provided at the fingertips on both sides or, for example, in the palm region on one side and the fingertip region on the other side. The mitt of FIG. 6 also preferably contains non-abrasive material 31 as discussed above.

Figure 7:
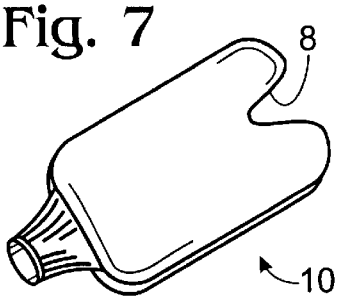

Referring to FIG. 7, a mitt 10 having a groove 8 provided therein for increased dexterity is in accordance with the present invention as shown. The mitt 10 of FIG. 7 also provides an abrasive and a non-abrasive cleaning surface as discussed elsewhere herein.

Figure 8:
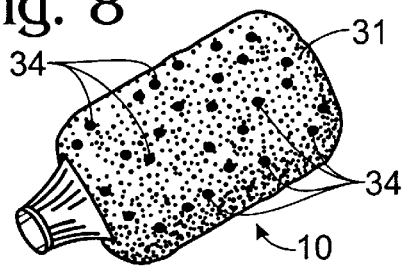

Referring to FIG. 8, another embodiment of a mitt 10 in accordance with the present invention is shown. Mitt 10 of FIG. 8 has a plurality of abrasive particles 34 glued or otherwise attached to the non-abrasive material 31. The particles may be made of plastic or rubber or the like and may be provided on one entire face or on region(s) of one or more faces.

Figure 9:
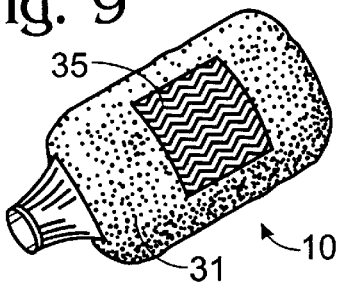

Referring to FIG. 9, yet another embodiment of a mitt 10 in accordance with the present invention is shown. Mitt 10 of FIG. 9 preferably includes non-abrasive material 31 as discussed above. An abrasive pad 35 is also preferably provided on the mitt. Pad 35 is preferably a scrub pad of the type used in household scrub pad sponge combinations or like material. The scrub pad may be applied directly to the non-abrasive material or a section of the non-abrasive material may be removed and the scrub pad inserted in its place (e.g., the wool batting of a polyester wool material can be removed and the scrub pad glued to the underlying substrate).

While polyester batting has been taught herein as one possible non-abrasive material, it should be recognized that other non-abrasive, water-absorbent materials can be used in its place. These include more conventional sponge like materials (e.g., open cell sponges and sponge foams), soft foam, and the like. As opposed to stitching, it may be necessary to join the sponge, foam or related materials with heat sealing or glue. These sponge or foam like materials may be provided in mitt 10 in whole or in part.

Other embodiments of a wash mitt in accordance with the present invention include the following. One is a mitt as described above, but with the abrasive mesh or other material provided on the inside. The mitt is turned inside out for utilization of the abrasive surface. Another is a mitt in which the abrasive material is detachable and, for example, may be slid over the mild surface and fastened with snaps, buttons or Velcro for use. In yet another, both sides (12,14) of the mitt include the abrasive surface. In this scenario, a conventional mitt may be used for cleaning more easily removable debris and the mitt with abrasive material on both sides is used for cleaning more stubborn debris.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A cleaning mitt apparatus, comprising:

a mitt body configured in a substantially planar manner and having a first section of wool batting and a second section of wool batting, the first and second sections of wool batting being disposed is a generally opposing manner about a central plane and being joined near their periphery so as to define a cavity therebetween of sufficient size to accommodate a human hand;

said second section of wool batting having an overlay of an abrasive mesh, said abrasive mesh and said second section of wool batting being arranged such that the second section of wool batting functions to maintain water and cleaning solution proximate said abrasive mesh in use; and said cleaning mitt apparatus further comprising a wrist member coupled substantially about an opening to the cavity for releasably securing said mitt apparatus about the wrist of a user with a user's hand in the cavity.

2. The apparatus of claim 1, wherein said wrist attachment member is an expandable cuff.

3. The apparatus of claim 1, further comprising a moisture-resistant layer that substantially lines the cavity to inhibit moisture in said first and second wool batting sections from propagating into the cavity.

4. The apparatus of claim 1, wherein the sections of wool batting are formed from a continuous piece of wool batting material.

5. The apparatus of claim 1, wherein said apparatus is configured to define at least a first finger groove that separates a finger region of the mitt apparatus to provide enhanced manual dexterity to a user's hand inside said mitt apparatus.

6. A cleaning mitt apparatus, comprising:

a mitt body configured to define a cavity therein that is of sufficient size to accommodate a human hand, said body being formed from a continuous sheet of absorbent material that is folded over to define a first cleaning section and a second cleaning section on opposite sides of the fold, said folded continuous material being substantially joined at the periphery thereof, inherently by said fold and by other means elsewhere, except for a human hand opening that permits insertion of a human hand into the cavity formed by the folded, peripherally joined material;

said continuous absorbent material being further characterized in that the material is readily water absorbent, supple and withstands well human-driven scrubbing;

wherein said mitt apparatus further includes a mildly abrasive material formed over said second cleaning section at an exterior surface thereof, said abrasive material being more abrasive than said continuous absorbent material; and an attachment mechanism provided at the human hand opening of said cavity to releasably secure the mitt apparatus about the hand of a user.

7. The apparatus of claim 6, wherein said continuous absorbent material is from one of the group of materials including:

wool, foam, and sponge.

8. The apparatus of claim 7, wherein said mildly abrasive material is achieved by providing on said second cleaning section abrasive material from the group of abrasive material including:

a mesh;

abrasive particles; and an abrasive scrub pad.

9. The apparatus of claim 6, wherein the continuous absorbent material is wool batting.

10. The apparatus of claim 6, wherein said abrasive material is a mesh overlay provided over said second cleaning section.

11. The apparatus of claim 10, wherein said abrasiveness is achieved by providing a mesh over substantially all of said second cleaning section.

12. The apparatus of claim 6, wherein said continuous absorbent material is wool batting and said abrasive material is mesh that overlays the second cleaning section.

13. The apparatus of claim 6, wherein said releasable hand attachment member is an expandable cuff.

14. The apparatus of claim 6, further comprising a moisture-resistant layer that substantially lines the cavity to inhibit moisture in said first and second cleaning sections from propagating into the cavity.

* * * * *

UNITED STATES PATENT AND TRADEMARK OFFICE

CERTIFICATE OF CORRECTION

PATENT NO. : 6,192,543 B1
DATED : February 27, 2001
INVENTOR(S) : Timothy R. Lee It is certified that error appears in the above-identified patent and that said Letters Patent is hereby corrected as shown below:

Column 3,
Line 19, delete "sage" and insert -- stage --.

Column 4,
Line 29, delete "is" and insert -- in --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*